US006263826B1

(12) United States Patent
Key

(10) Patent No.: US 6,263,826 B1
(45) Date of Patent: Jul. 24, 2001

(54) BOAT SPRINKLER APPARATUS

(76) Inventor: Johnny Key, 7 Key Hollow La., Travelers Rest, SC (US) 29690

( * ) Notice: Subject to any disclaimer, the term of this patent is extended or adjusted under 35 U.S.C. 154(b) by 0 days.

(21) Appl. No.: 09/396,609

(22) Filed: Sep. 15, 1999

(51) Int. Cl.[7] ..... B63B 8/00
(52) U.S. Cl. ..... 114/343; 114/361
(58) Field of Search ..... 114/343, 361, 114/364; 135/88.01, 88.03, 93; 440/39

(56) References Cited

U.S. PATENT DOCUMENTS 5,044,298 9/1991 Pepper et al. .
5,520,139 5/1996 King et al. .
5,613,731 * 3/1997 Aspinall ..... 297/180.15
5,628,273 5/1997 Crouse, II .
5,823,617 * 10/1998 Schafer ..... 297/180.15

* cited by examiner

*Primary Examiner*—Ed Swinehart
(74) *Attorney, Agent, or Firm*—Dority & Manning, PA

(57) ABSTRACT

A fountain canopy is provided having a water intake positioned below the water line of a boat which directs water from a pump through a conduit. A portion of the conduit is threaded through a frame supporting a boat canopy. An outlet of the frame allows a discharge end of the conduit to be connected to a discharge nozzle which generates a coarse spray of water upwardly, the spray cascading downwardly in a rain-like shower around the boat and surrounding vicinity.

8 Claims, 4 Drawing Sheets

BOAT SPRINKLER APPARATUS

FIELD OF THE INVENTION

This invention relates to a recreational sprinkler system which directs a coarse spray of water onto portions of a boat and an area surrounding the boat.

BACKGROUND OF THE INVENTION

Boat canopies are commonly found on a variety of pleasure boats such as pontoon boats. Typically, a canopy protects a portion of the boat and boat occupants from adverse weather conditions. During hot weather, the canopy provides shade for the occupants.

U.S. Pat. No. 5,628,273 Crouse, II discloses a misting apparatus for a boat in which a plurality of misters are secured to a canopy frame, the misters directing a fine mist to an area beneath the canopy.

While the misting apparatus disclosed in Crouse, II is useful for cooling occupants positioned beneath the canopy, the use of a misting apparatus eliminates any sheltered area within the boat where an occupant or articles may be placed to stay dry. Further, the misting apparatus would be ineffective at cooling a passenger who may be outside the canopy.

Accordingly, there remains room for improvement and variation within the art.

SUMMARY OF THE INVENTION

A general purpose of the present invention is to provide a recreational sprinkler which is adapted for a boat canopy which provides a refreshing, rain-like cascade effect upon an open area of the boat and areas immediately surrounding the boat. Further, the present invention maintains the integrity of a sheltered area beneath the canopy where individuals or supplies may reside to avoid exposure to the resulting spray.

The present invention also provides canopy in which the canopy frame provides a protective enclosure for a water supply line, the water supply line in communication with a sprinkler head supported along an elevated portion of the canopy frame. The sprinkler head may further provide useful ornamentation compatible with a boating motif and environment.

The present invention also provides an upwardly directed fountain spray which then cascades downward in a rain-like effect upon an area adjacent the canopy and sprinkler head. This area may include a portion of the boat as well as an adjacent area surrounding the boat. This arrangement allows the resulting spray to be enjoyed by users who may be swimming in the water adjacent the boat and could extend to a portion of a boat dock.

The sprinkler system provides a useful cooling spray for occupants of the boat, thereby increasing the enjoyment of the boating experience and extending the duration or time of day in which recreational boating activities may be enjoyed. The canopy sprinkler system may be operated while the boat is moving or stationary.

The sprinkler apparatus, under suitable lighting conditions, will refract sunlight to provide a rainbow which is visible to the passengers and passers-by. The rainbow created by the sprinkler apparatus adds to the passengers'recreational enjoyment.

The present invention has surprisingly been found to offer a beneficial effect on sport fish activity by creating a disturbance in the surface water which is believed to stimulate the movement of certain bait fish.

These along with other advantages and features of the present invention are provided by a fountain spray canopy for a boat comprising:

- an inverted U-shaped frame supporting a canopy, the frame defining an outlet along an elevated frame element;
- a conduit for the passage of water, the conduit having a first end and a second end, the first end of the conduit in communication with the frame outlet and a portion of the conduit operatively disposed within an interior channel defined within the frame, the second end of the conduit in communication with an intake positioned below the water line of a boat;
- a nozzle supported by the canopy frame and having a first nozzle end in communication with the conduit first end and a second nozzle end defining a spraying tip;
- a pump operatively disposed between the first conduit end and the second conduit end, wherein the pump directs the intake of water into the second conduit end which passes through the conduit and is discharged through the spraying tip of the nozzle.

DETAILED DESCRIPTION OF A PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention, without departing from the scope or spirit of the invention. For instance, features illustrated or described as part of one embodiment, can be used in another embodiment to yield a still further embodiment. Thus, it is intended that present invention covers such modifications and variations as come within the scope of the appended claims and their equivalents. Other objects, features, and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

In general, the present invention relates to a fountain canopy. As used herein, the term fountain canopy refers to a canopy in which the canopy frame further supports a nozzle for directing a coarse spray of water in an upward direction so as to subsequently cascade downward in an area surrounding the canopy.

Figure 1:
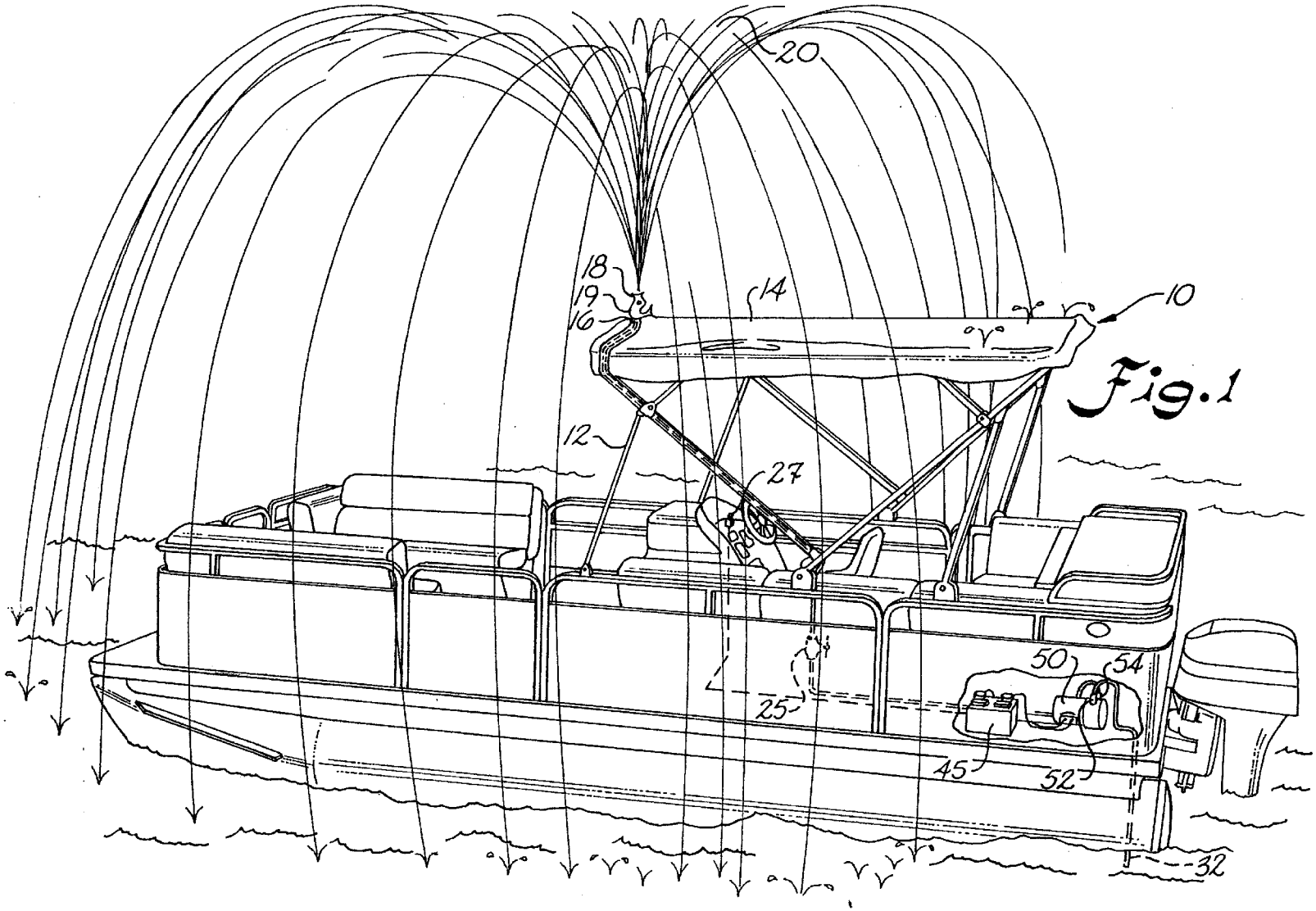
FIG. 1 is a perspective view of a pontoon boat showing details of the sprinkler apparatus of the present invention.

As seen in FIG. 1, one embodiment of the invention is shown. The canopy sprinkler for a pontoon boat is seen in the form of an adjustable canopy 10 which encloses a portion of the boat 11. The canopy is held in place by a frame 12, typically made of metal. In the illustrated embodiment, the main frame element of the canopy is provided by a rectangular shaped upper member 14. Upper member 14 is supported by lateral frame members 16 attached to the sides of boat 11. Preferably, the frame members define a hollow interior or a recessed channel which provides a passageway through an interior of the frame member. Such frame members may include hollow metal tubing, square tubing, along with other conventional materials used in canopy frames.

As seen in FIG. 1, an elevated segment of the canopy frame defines an opening 16 to which a nozzle 18 is attached. A free end of the nozzle 18 is configured to direct a plurality of streams of water 20 upwardly into the air. The opposite nozzle end is in further communication with a supply conduit 30. As seen in FIG. 1, a portion of the supply line conduit 30 (dashed lines) is positioned within the interior passageway of the canopy frame.

The conduit 30 may be provided by any conventional flexible fluid line including Tygon tubing, rubber hose, silicon tubing, etc. Preferably, the tubing is flexible, has a wide temperature range, and is amenable to the movement of the canopy as it folds into various positions. Further, the conduit has an outer diameter to allow insertion into the canopy frame and has sufficient burst strength to accommodate the water pressures encountered in a normal pumping and supply environment.

The conduit is in further communication with a pump seen as a battery-operated electric pump 50 with battery 45. As illustrated, the pump 50 is operatively disposed within the conduit 30 so that a free end 32 of the conduit collects water surrounding the boat into the conduit, the water passing through the pump inlet 52 and the pump outlet 54 into the remaining length of the conduit 30 prior to exiting from the nozzle. A switch 27 may be installed in a conventional manner to control the operation of the electric pump 50.

Figure 4:
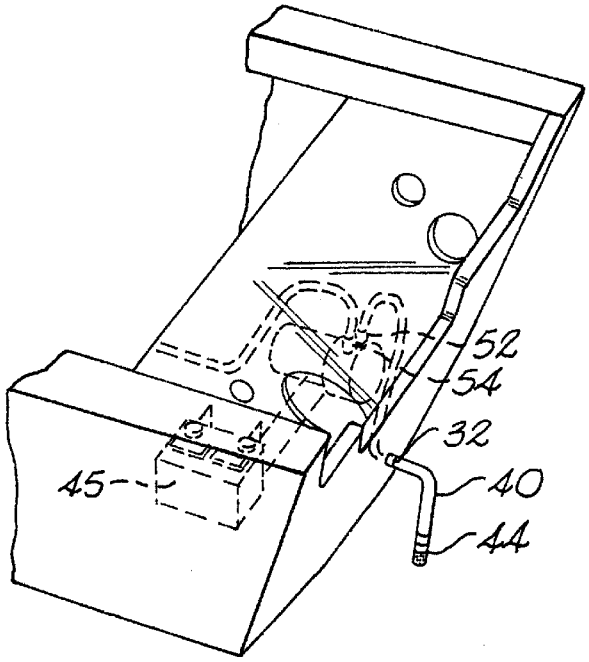
FIG. 4 illustrates details of a pump and water intake arrangement suitable for use with the present invention.
Figure 5:
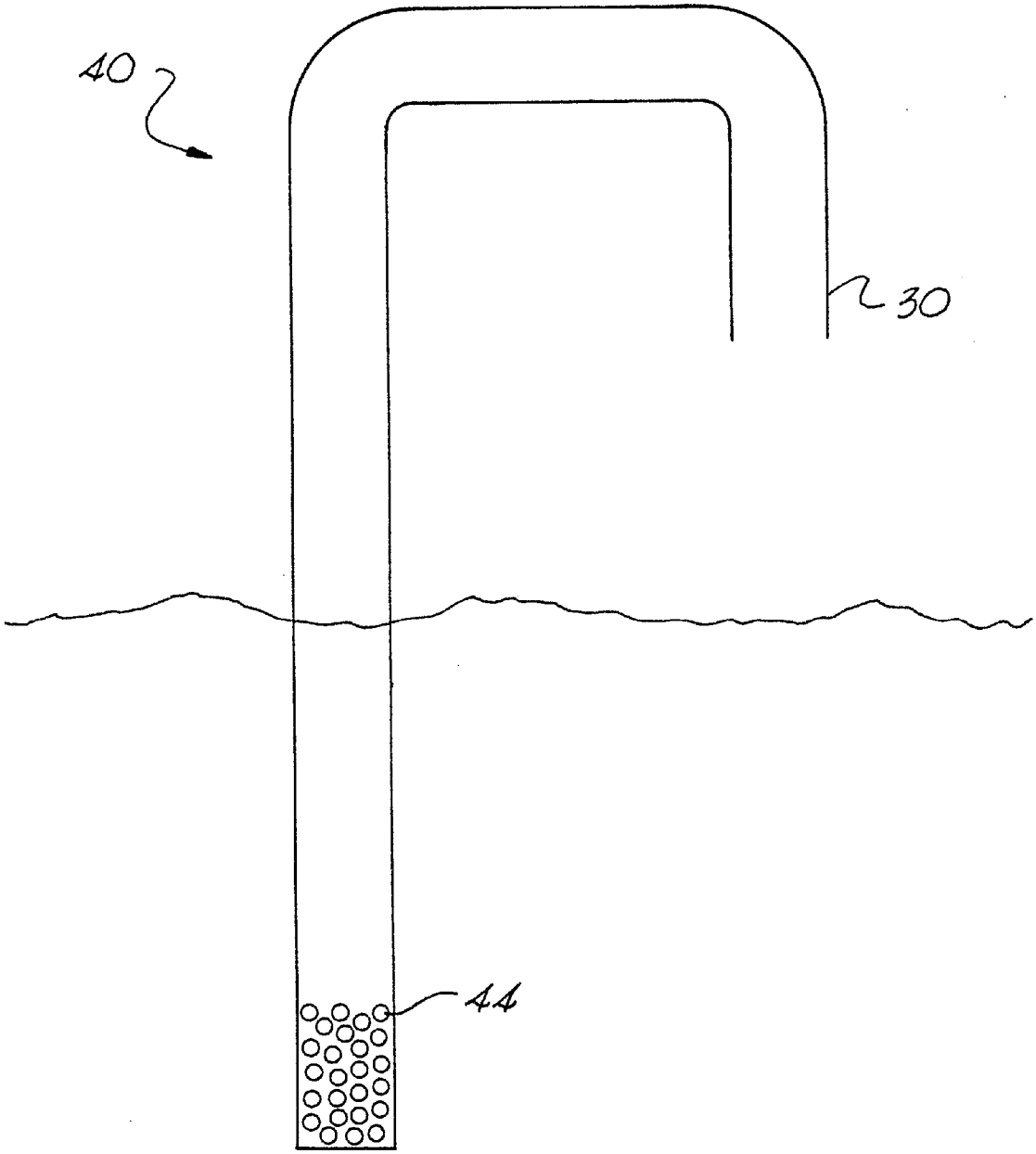
FIG. 5 illustrates an alternative embodiment of the pick-up portion of the conduit having a U-shaped resilient clasping member for engaging an edge portion of the boat.

As illustrated, end 32 of the conduit is in communication with the lake or other body of water. In an embodiment suitable for a pontoon-type boat (FIG. 1), the water supply conduit end is placed directly into the body of water. For other styles of boats, a separate pick-up tube 40 may be provided which communicates through the stern of the boat to a region below the water line of the boat. As seen in FIG. 4, an opening may be provided through the stern of the boat. Further, an external pick-up tube of varying length may be provided as part of the overall conduit pathway. One such draw tube is seen in U.S. Pat. No. 5,628,273 which is incorporated herein by reference. Where a permanent connection is not available or desired, the conduit may include a length of pre-bent tubing which is designed to extend over and mount in a clasping fashion to a stern or edge of the boat.

The terminal end of the conduit or pick-up tube 40 which provides the intake of water for the sprinkler system may further comprise a screen, mesh, or other finely perforated structure 44 to prevent the intake of large debris which may occlude the conduit. Additional in-line filters may also be used to filter out finer suspended particles which may otherwise interfere with the sprinkler discharge orifice. One useful design employs a pick-up tube having a plurality of small diameter apertures or openings in the tube wall. The apertures provide an intake source while excluding larger debris. Further, such a design is self-cleaning as the boat is propelled through the water which will direct a counter-current through the pick-up portion of the conduit.

The pump may be operated by a separate battery 45 or tied in to an already existing electrical system of the boat. A variety of different sizes and types of pumps may be employed, the selection and use of which is well within ability of one having ordinary skill in the art. As a general rule, a higher volume of water or a greater discharge velocity may be achieved by a more powerful pump. Since one of the objects of the present invention is to provide a cooling and refreshing source of water for passengers in the boat, the intake portion of the conduit may be placed several feet below the surface of the water, thereby using cooler water than would otherwise be obtained near the surface of the water.

As seen in reference to the figures, the nozzle may be incorporated into an ornamental sprinkler head 19 seen in the form of a fish. However, other ornamental designs may be used. The discharge nozzle 18 may be of a fixed and permanent design. Alternatively, the nozzle may be adjustable as to a discharge angle as well as a discharge pattern so as to vary the area, distance, and shape of the water discharge pattern. A flow valve 25 may be positioned within the conduit 30 and/or associated with the sprinkler head 18. Control valve 25 may be used to regulate the flow and velocity of water supplied to the sprinkler head in order to better achieve a desirable spray pattern.

Figure 2:
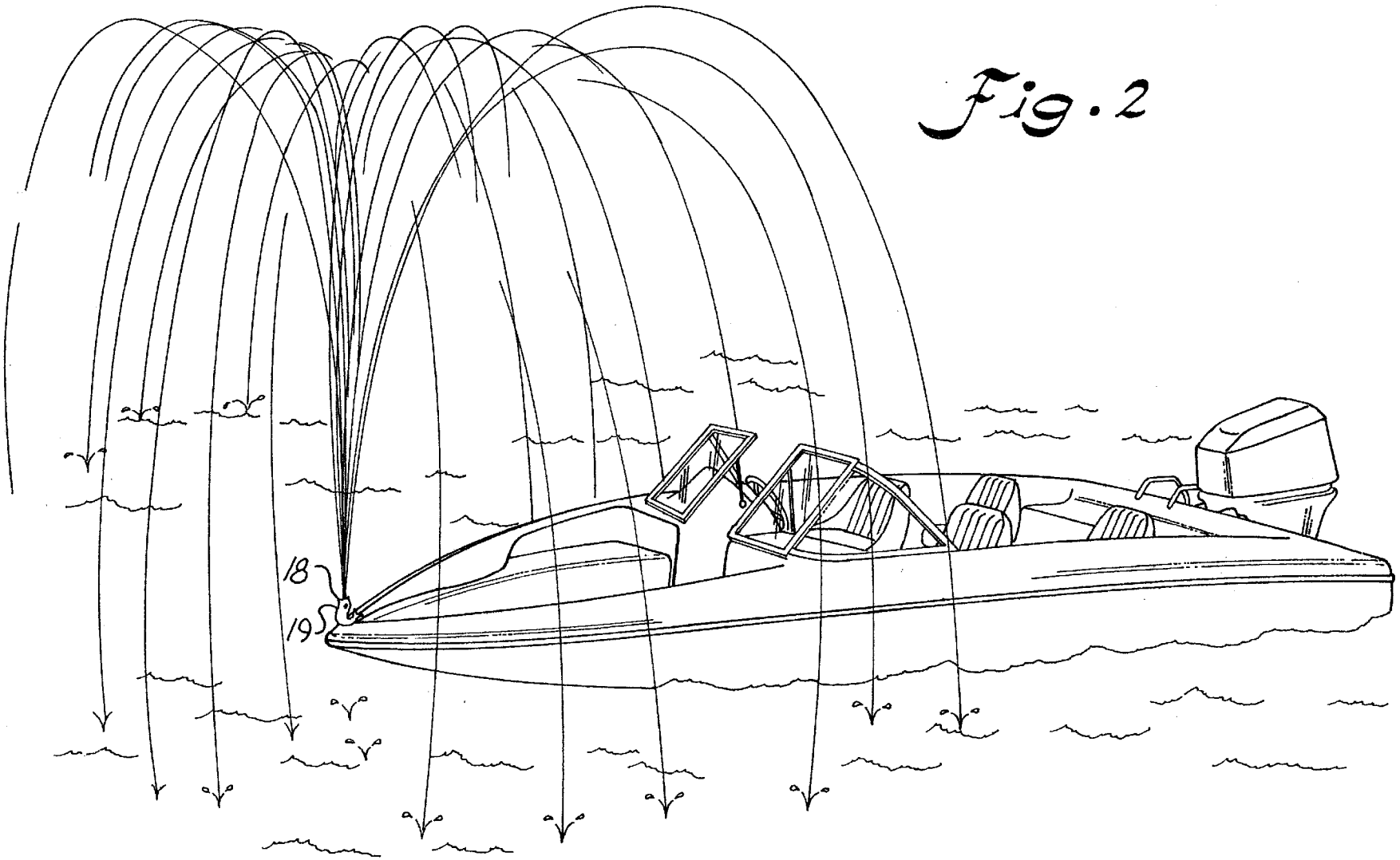
FIG. 2 is an alternative embodiment of a boat sprinkler apparatus suitable for use on a non-canopy boat.
Figure 3:
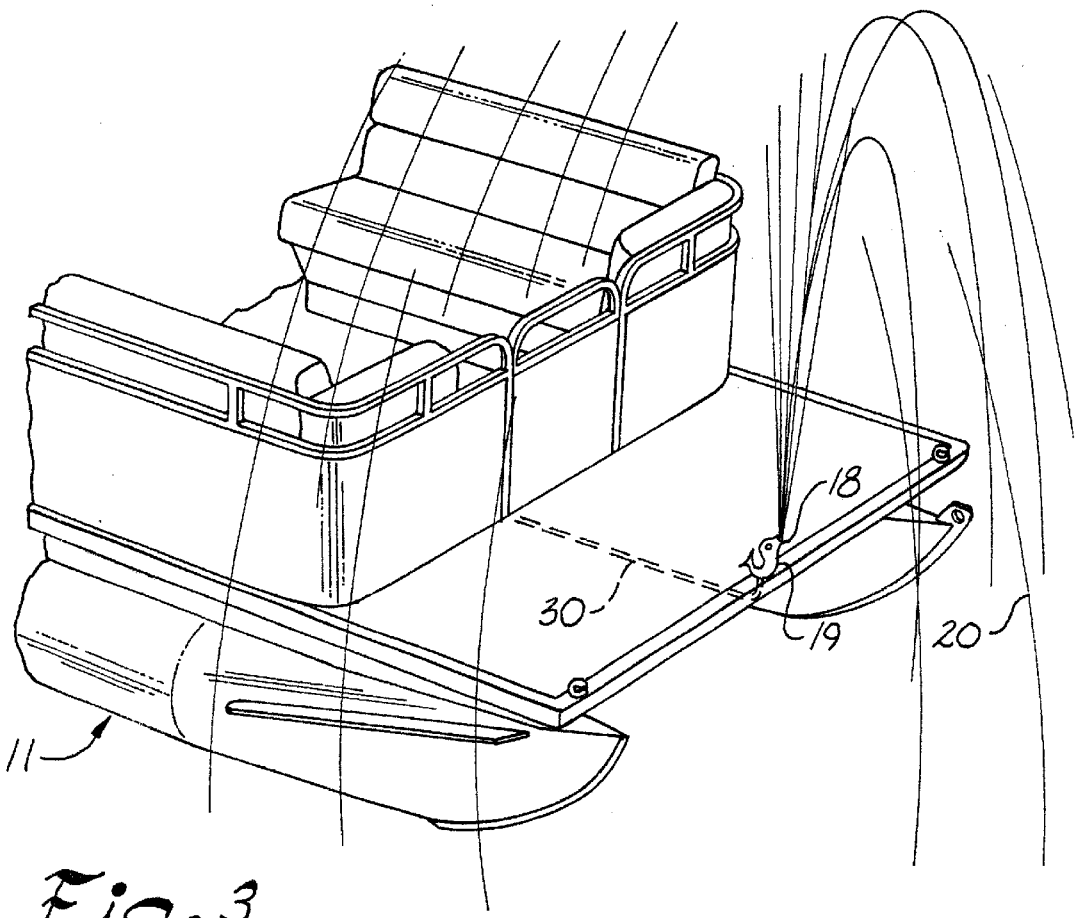
FIG. 3 is an alternative embodiment of the sprinkler apparatus for mounting on a boat at a location other than a canopy.

As seen in reference to FIGS. 2 and 3, a variation of the invention is provided for use on a boat which does not require the use of a canopy. For instance, many pleasure craft, such as a ski boat or fishing boat, lack a canopy. Accordingly, the alternative embodiment makes use of a similar pump 50 and conduit material 30, but as seen in FIGS. 2 and 3, the length of the conduit which extends to sprinkler head 18 does not pass through a canopy frame. The sprinkler head may be temporarily attached to a structure of the boat by a clamp or suction device, or permanently mounted upon a structure of the boat. Again, an aesthetically pleasing and ornamental sprinkler design can be provided from which the discharge nozzle directs a fountain spray of water.

The above embodiments may greatly increase passenger comfort during hot weather. The intake conduit can bring up cooler water beneath the surface of the lake which is more refreshing than swimming or immersion in the heated upper water layers. Further, the cooling effect can be enhanced by movement of the boat, thereby increasing the cooling evaporative effect by the resulting breeze. Additionally, the sprinkler system can benefit swimmers and allows passengers the option of staying dry under the canopy.

In addition, a further advantage of the invention relates to applicant's observation that the cascading effect of the water upon the lake surface has been found to stimulate fishing activity in shallow water and around structures such as piers, docks, and other cover. While not wishing to be bound by theory, it is applicant's belief that the impact of the water onto the lake's surface mimics surface activity of bait fish and thereby attracts the attention of nearby game fish.

Although preferred embodiments of the invention have been described using specific terms, devices, and methods, such description is for illustrative purposes only. The words used are words of description rather than limitation. It is to be understood that changes and variations may be made of ordinary skill in the art without departing from the spirit of the scope of the present invention which is set forth in the following claims. In addition, it should be understood that aspects of the various embodiments may be interchanged, both in whole or in part. Therefore, the spirit and scope of the appended claims should not be limited in the description of the preferred versions contained therein.

What is claimed is:

1. A fountain canopy for a boat comprising:

a frame supporting a canopy, the frame defining an outlet along an elevated portion of the frame;

a conduit having a first end and a second end, the first end of the conduit in communication with the outlet and a portion of the conduit operatively disposed within an interior channel defined by the canopy frame, the second end of the conduit adapted for placement below the water line of the boat, the second end of the conduit defining a pick-up tube;

a nozzle supported by the frame and having a first nozzle end in communication with the conduit first end and a second nozzle end defining a discharge tip, the second nozzle end and discharge tip mounted above an upper surface of the canopy and said discharge tip positioned in an upward direction; and, a pump operatively disposed within the flow path of the conduit;

wherein when the pump is operated, water is directed into the second conduit end, passing through the length of the conduit and discharging through the nozzle spray tip, forming a plurality of streams of water which cascades downwardly, a portion of said plurality of streams of water descending into an area surrounding the boat.

2. The fountain canopy according to claim 1 wherein the conduit is in further communication with a valve.

3. The fountain canopy according to claim 1 wherein the second end of the conduit defines a pick-up tube, an exterior of the pick-up tube defining a plurality of perforations through an outer wall.

4. The fountain canopy according to claim 1 wherein the discharge spray pattern is adjustable.

5. The fountain canopy according to claim 1 wherein the nozzle is housed within an ornamental, animated sprinkler head.

6. The fountain canopy according to claim 1 wherein the second end of the conduit defines an inverted U-shaped length for engaging an edge of the boat.

7. The fountain canopy according to claim 1 wherein the conduit housed within the canopy frame channel permits the canopy and canopy frame to be folded into a storage position.

8. A fountain canopy for a boat comprising:

a frame supporting a canopy, the frame defining a nozzle attachment site along an elevated portion of the frame;

a conduit having a first end and a second end, the first end of the conduit in communication with the nozzle attachment site, a portion of the conduit operatively disposed within an interior channel defined by the canopy frame, the second end of the conduit adapted for placement below the water line of the boat;

a nozzle supported by the frame along said nozzle attached site and having a first nozzle end in communication with the conduit first end and a second nozzle end defining a discharge tip, the second nozzle end and discharge tip mounted above an upper surface of the canopy and said discharge tip positioned in an upward direction; and, a pump operatively disposed within the flow path of the conduit;

wherein when the pump is operated, water is directed into the second conduit end, passing through the length of the conduit and discharging through the nozzle spray tip, forming a plurality of streams of water which cascades downwardly, a portion of said plurality of streams of water descending into an area surrounding the boat.

* * * * *